US007845522B2

(12) United States Patent
Grill

(10) Patent No.: US 7,845,522 B2
(45) Date of Patent: Dec. 7, 2010

(54) INTEGRATED AND DISPOSABLE DISPENSER ASSEMBLY

(75) Inventor: Benjamin Grill, Woodland Park, CO (US)

(73) Assignee: Sturman BG, LLC, Woodland Park, CO (US)

( * ) Notice: Subject to any disclaimer, the term of this patent is extended or adjusted under 35 U.S.C. 154(b) by 1175 days.

(21) Appl. No.: 11/345,963

(22) Filed: Feb. 2, 2006

(65) Prior Publication Data

US 2006/0169725 A1 Aug. 3, 2006

Related U.S. Application Data

(60) Provisional application No. 60/649,745, filed on Feb. 2, 2005.

(51) Int. Cl.
*B65D 83/00* (2006.01)

(52) U.S. Cl. ..... 222/399; 137/212

(58) Field of Classification Search ..... 222/399, 222/397, 398, 153.1, 153.11, 396; 137/212, 137/495, 505.42, 505.11, 505.26, 206, 209
See application file for complete search history.

(56) References Cited

U.S. PATENT DOCUMENTS

| | | | | |
|---|---|---|---|---|
| 2,547,052 | A * | 4/1951 | Sollman | 141/17 |
| 3,065,883 | A | 11/1962 | Nelson | |
| 3,211,350 | A * | 10/1965 | Brown | 222/399 |
| 3,434,632 | A * | 3/1969 | Batrow | 222/400.5 |
| 4,402,429 | A * | 9/1983 | Vanden Driessche | 222/153.01 |
| 4,632,276 | A * | 12/1986 | Makino | 222/80 |
| 5,022,565 | A * | 6/1991 | Sturman et al. | 222/396 |
| 5,110,012 | A | 5/1992 | Scholle et al. | |
| 5,395,012 | A | 3/1995 | Grill et al. | |
| 5,443,186 | A | 8/1995 | Grill | |
| 5,979,713 | A | 11/1999 | Grill | |
| 6,036,054 | A | 3/2000 | Grill | |

FOREIGN PATENT DOCUMENTS

| | | |
|---|---|---|
| DE | 202 06 874 U1 | 8/2002 |
| GB | 2 010 977 A | 7/1979 |
| WO | WO - 89/00544 | 1/1989 |

* cited by examiner

*Primary Examiner*—Lien T Ngo
(74) *Attorney, Agent, or Firm*—Blakely Sokoloff Taylor & Zafman LLP

(57) ABSTRACT

Integrated and disposable dispenser assemblies that initially are contained entirely or at least substantially entirely within a beverage container, but which may be removed therefrom and placed in an operative position, pressurizing the contents of the container, avoiding prolonged contact between the contents of the container and air, providing a dispensing force for control by a simple dispensing valve and in those instances where it is desired, maintaining carbonation on the beverage. Two representative embodiments are disclosed, one of which may be contained in a single enclosure within a beverage container, and the other of which may be contained in two enclosures within a beverage container.

21 Claims, 8 Drawing Sheets

INTEGRATED AND DISPOSABLE DISPENSER ASSEMBLY

CROSS-REFERENCE TO RELATED APPLICATION

This application claims the benefit of U.S. Provisional Patent Application No. 60/649,745 filed Feb. 2, 2005.

BACKGROUND OF THE INVENTION

1. Field of the Invention

The present invention relates to the field of beverage dispensers.

2. Prior Art

Beverages, while frequently packaged in individual serving size containers, are also sometimes packaged in significantly larger containers, such as by way of example, 5 and 6 liter unpressurized cans. In the case of many beverages, exposure to air for a substantial length of time can adversely affect the taste of the beverage, or even accelerate the spoilage of the beverage. By way of example, beer is available in such cans and, for dispensing through a gravity feed dispenser, the can is vented to allow air to replace beer as it is being dispensed. If the beer is consumed over a period of a few hours, there is no problem, though if such a container is left partially empty, the air which has replaced the beer already dispensed will very substantially affect the taste of the beer over a more extended time period, even if left in the refrigerator, so as to have an unfavorable of taste in a matter of a few days.

Also known are attachments for beverage containers which will pressurize the beverage containers with a gas such as carbon dioxide or nitrogen at a regulated pressure and provide a dispensing valve for the beverage. These devices prevent air from back-filling the beverage container as the beverage is consumed, and further provide a convenient beverage dispensing force. Further, in the case of a carbonated beverage, such devices maintain good carbonation in the beverage for however long it takes for the entire beverage to be consumed, no matter how much or how little is left in the container. Such devices are available, by way of example, from Sturman BG, LLC. Such devices are normally coupled to the beverage container by removable of the beverage container cap and screwing the dispenser assembly onto the beverage container in place of the cap. The devices, when mounted on a beverage container, are substantially all external to the beverage container and are designed to be removed and reused when the beverage container becomes empty.

DETAILED DESCRIPTION OF THE PREFERRED EMBODIMENTS

Figure 1:
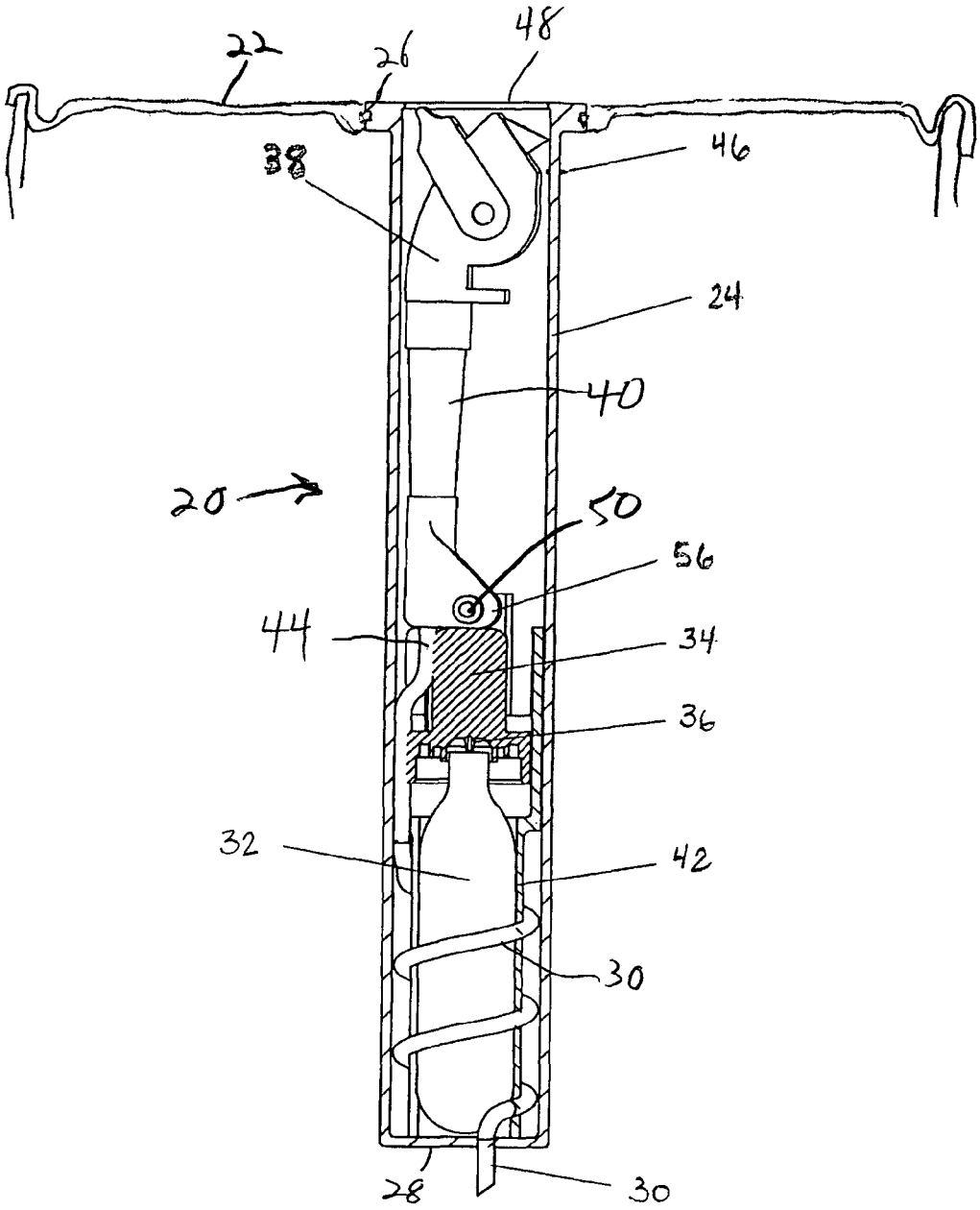
FIG. 1 is a partial cross section illustrating one embodiment of the integrated and disposable dispenser assembly of the present invention stored within a beverage container for shipment, display and sale.

First referring to FIG. 1, a cross section of the present invention dispenser, generally indicated by the numeral 20, as mounted in a beverage container 22 may be seen. The main assembly of the beverage dispenser is mounted within closed end tubular member 24 coupled at the top 26 to container 22 in a manner generally schematically shown. This connection may be by way of various well-known means and is a matter of design choice. Tubular member 24 is closed at the lower end 28, though has a beverage inlet tube 30 extending through the bottom 28 of the tubular member 24 for extending downward to the bottom of the container 22. In that regard, in normal use the container 22 will be disposed in a vertical orientation as illustrated in FIG. 1, though of course may be shipped, stored and displayed in any orientation.

Mounted within tubular member 24 is an assembly holding a gas cartridge 32, a pressure regulator 34 having a piercer 36 at the lower end thereof, and a beverage dispenser head comprising a dispensing valve 38 and a diffuser 40. The regulator 34 may be in accordance with any well-known pressure regulator design, typically maintaining a pressure in the beverage container when activated, selected in accordance with the beverage and objectives to be obtained. Similarly, the size of the gas cartridge 32 will be selected in accordance with the pressure to be maintained and the size of the container 22 within which that pressure is to be maintained. In the conditions shown in FIG. 1, part of the inlet tube 30 is wrapped around the sliding assembly 42, with the upper end 44 thereof being coupled to the diffuser 40, which in turn is coupled to the dispensing valve 38. In the conditions shown, the assembly comprising the regulator 34 and the piercer 36 is positioned over gas cartridge 32, leaving the gas cartridge sealed. Also visible in FIG. 1 is a check valve 46, which by way of example, may be a duck bill check valve, configured to allow gas to pass from the pressure regulator 34 inside the tubular member 24 into the container 22, but to prevent beverage or gas leakage in the opposite direction.

Figure 2:
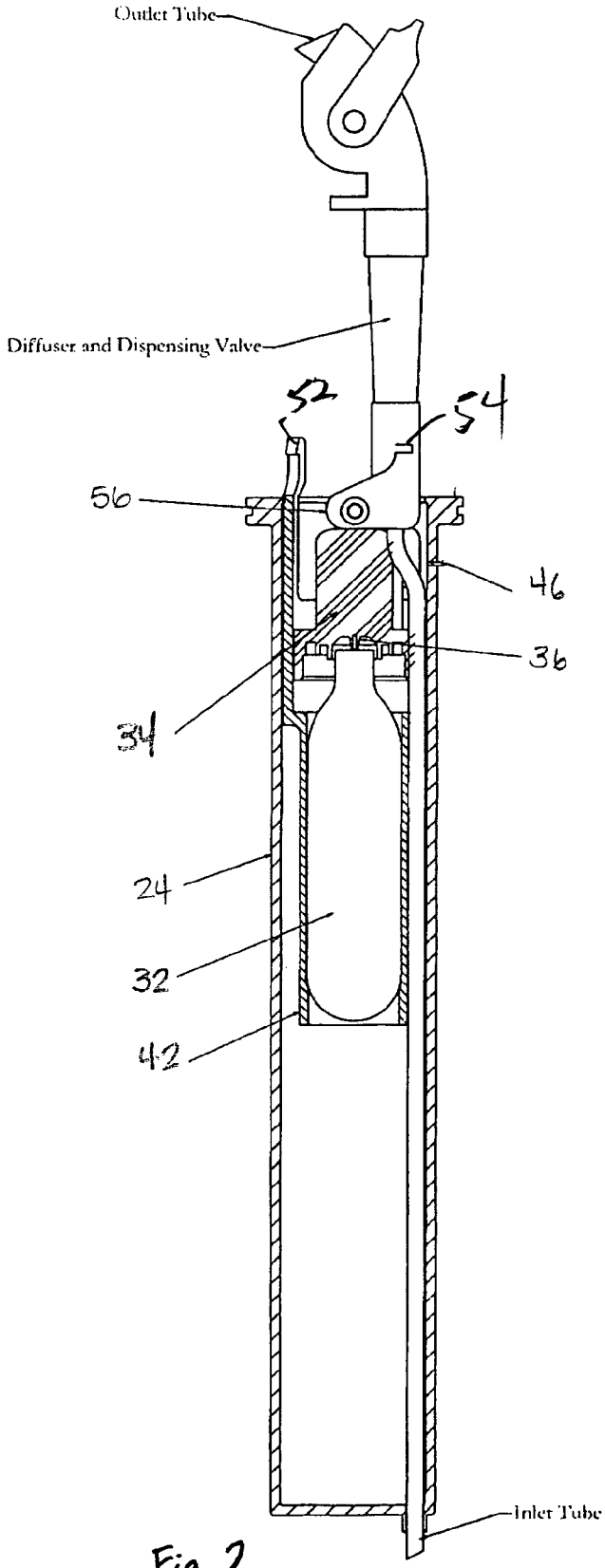
FIG. 2 is a partial cross section illustrating the integrated and disposable dispenser assembly of the present invention being withdrawn from a container preparatory to rotation to its operative position.
Figure 3:
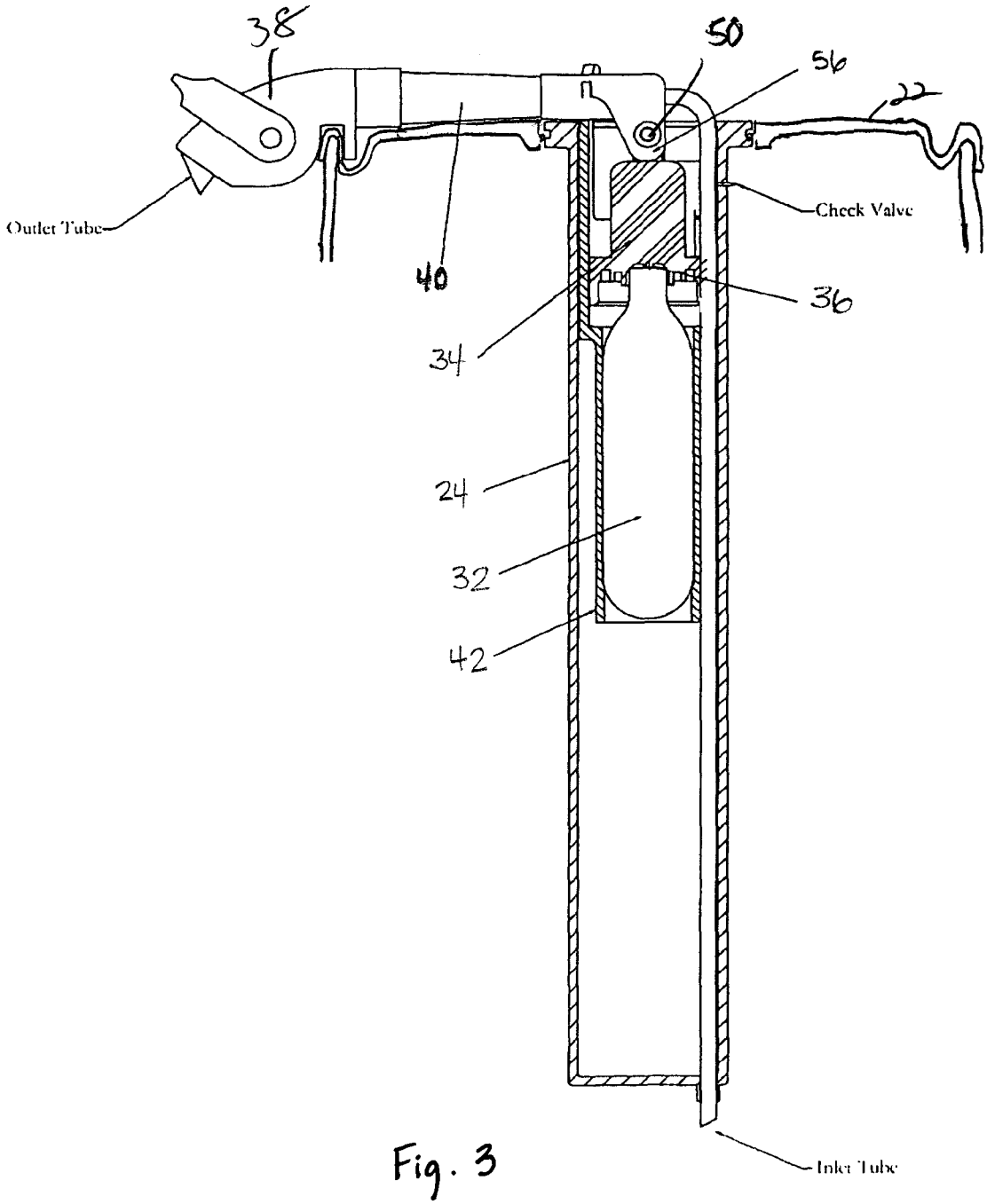
FIG. 3 is a partial cross section illustrating the integrated and disposable dispenser assembly of the present invention in its operative position.

In a typical assembly in accordance with FIG. 1, some form of removable seal will be provided over the top 48, such as an adhesive seal spanning the top 26 of the dispenser assembly and adhesively sealing onto the adjacent surface of container 22. In use, the seal at the top 48 is peeled away and the dispenser assembly within tubular member 24 is raised as illustrated in FIG. 2. In this position, a seal (not shown in detail) couples the output of regulator 34 to the check valve 46. Once in a vertical position, the assembly comprising the diffuser 40 and dispensing valve 38 (the beverage dispenser head) is rotated about pivot 50 approximately 90 degrees, as shown in FIG. 3, until hooks 52 (FIG. 2, only one being shown in FIG. 2) hook over ears 54 to hold the diffuser and dispensing valve in the position shown in FIG. 3. As the assembly is rotated from the position shown in FIG. 2 to the position shown in FIG. 3, cams 56 force the regulator assembly 34 downward, causing the piercer 36 to pierce the gas cartridge 32 with the outlet of the regulator being passed into the interior of container 22, pressurizing the contents of the container for automatic dispensing as controlled by the dispensing valve 38. Typically the gas will be $CO_2$ for both carbonation and pressurization for beverage dispensing, though other gases may be used depending on the application. By way of one example, nitrogen is sometimes used for preservation and pressurization for dispensing, such as with uncarbonated beverages that may spoil or loose their proper taste if exposed to oxygen, such as wine. Also while the disposable dispenser of FIGS. 1 through 3 is shown mounted in the center of the beverage container, it may as easily be mounted toward one side of the container top so as to be mountable before foiling the container without interfering with the operation of center filing equipment.

Figure 4B:
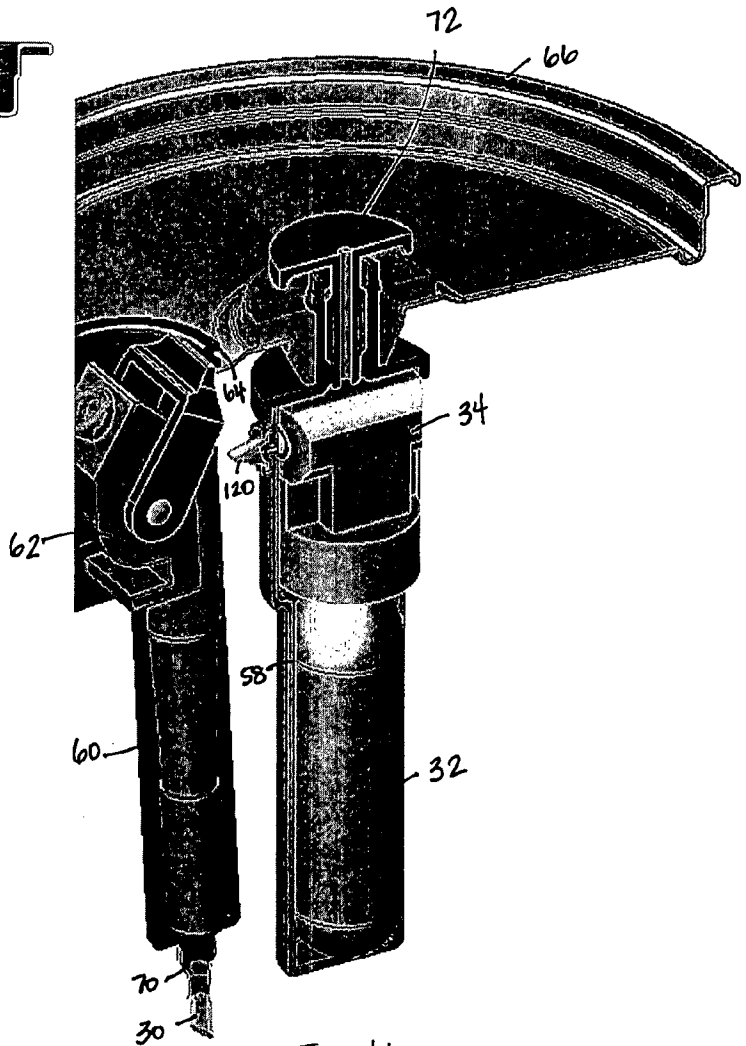
FIGS. 4*a* and 4*b*, and 5*a* and 5*b* are views of another embodiment of the disposable dispenser assembly of the present invention.
Figure 4A:
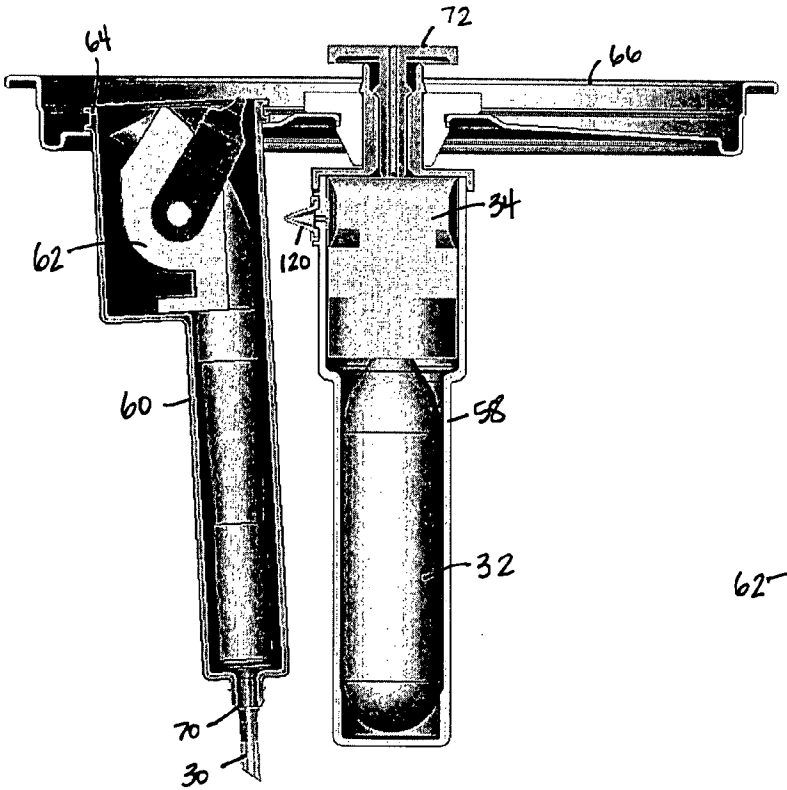
Figure 5B:
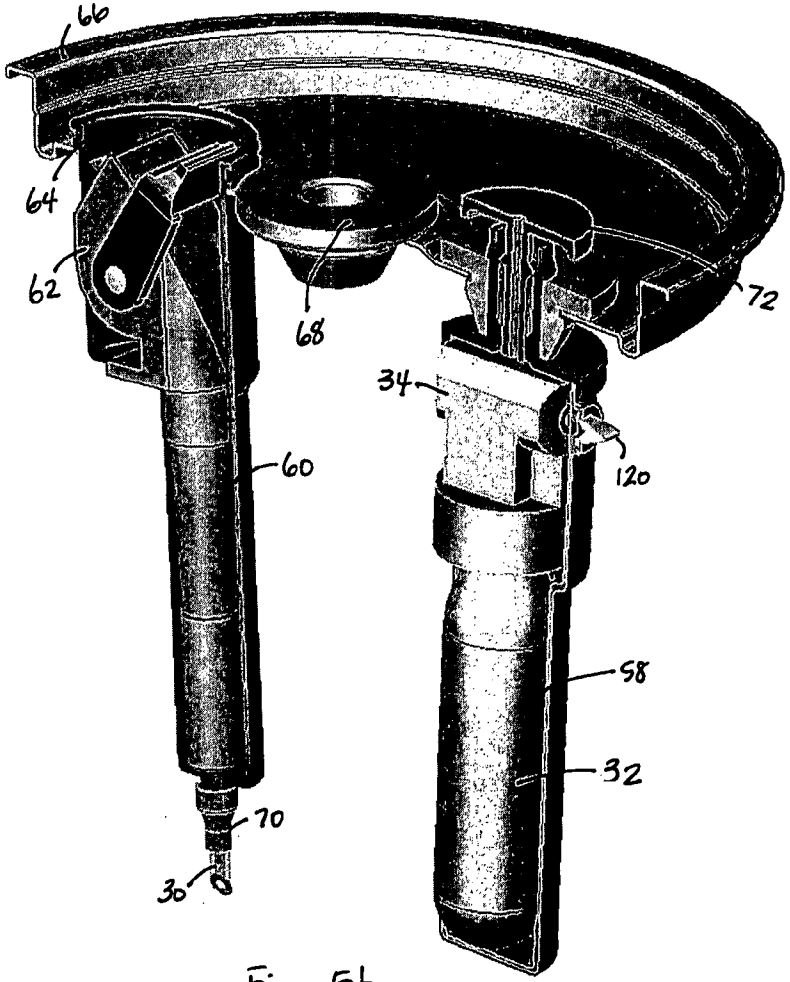
Figure 5A:
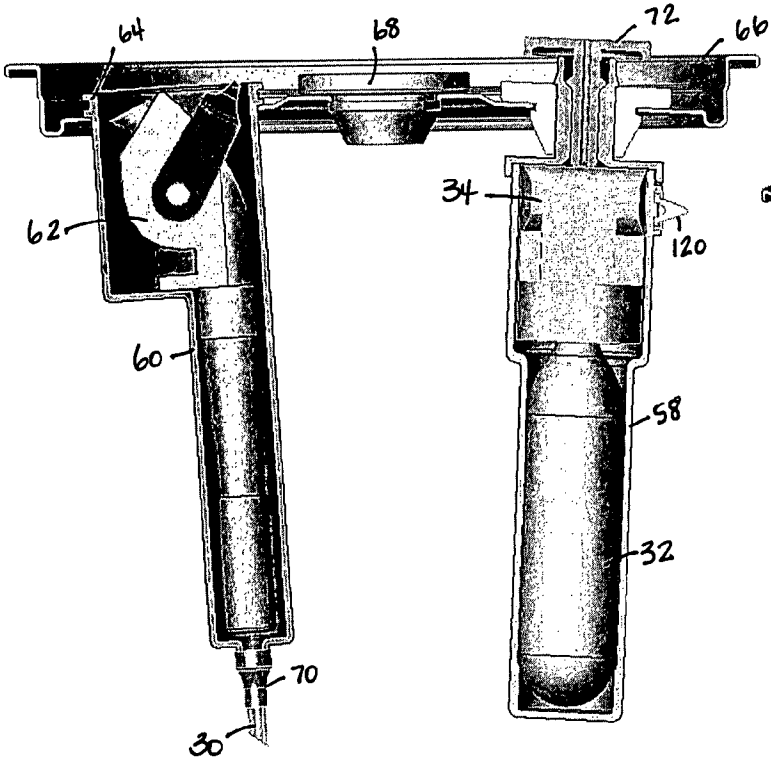

Another embodiment of the disposable dispenser assembly of the present invention may be seen in FIGS. 4*a* and 4*b*, and 5*a* and 5*b*. In this embodiment, the housing 58 containing the gas cartridge 32 and pressure regulator 34 is separate from the housing 60 containing the beverage dispenser head, generally indicated by the numeral 62. In that regard, the upper end 64 of housing 60 will be sealed with respect to the top 66 of the container, typically a 5 liter can, though other sizes and container types obviously may be accommodated. The difference between the configurations of FIGS. 4*a* and 4*b* and FIGS. 5*a* and 5*b* is the location of the assembly containing the gas cartridge 32 and the pressure regulator 34*t*, the configuration of FIGS. 4*a* and 4*b* locating the same at the center of the top 66, whereas in the configuration of FIGS. 5*a* and 5*b* this assembly is located off-center, with the opening in the center being plugged by a separate plug 68. The configuration of FIGS. 5*a* and 5*b* leave the center of the top of the can free so that the canned may be filled through the center prior to placement of the plug 68 therein to seal the can. In the configuration of FIGS. 4*a* and 4*b* the can could be filled before the top is placed thereon and sealed, or alternatively, the assembly containing the gas cartridge 32 and the pressure regulator 34 could be placed in the can to seal the center opening for filling once filling was completed, provided the opening in the center of the can was appropriately configured.

The beverage dispenser head 62 in the housing 60 of the embodiment of FIGS. 4*a* and 4*b*, and 5*a* and 5*b*, may be substantially the same as the beverage dispenser head in the embodiment of FIGS. 1 through 3, perhaps reproportioned so that the same can be withdrawn from housing 60, rotated 90 degrees and held by the edge of the can, as shown in FIG. 3. Of course, in the embodiment of FIGS. 1 through 3, rotating the dispenser through the 90 degree angle provides a cam action to cause the regulator assembly 34 to pierce the gas cartridge 32, whereas in the embodiment of FIGS. 4*a* and 4*b*, and 5*a* and 5*b*, the same function is achieved by rotation of piercing knob 72, which may be done before or after the dispenser is withdrawn and placed in an operative position. Also, in the embodiment of FIGS. 1 through 3, the length of beverage inlet tube 30 provided to accommodate the withdrawal of the dispenser assembly is coiled within tubular member 24, whereas in the embodiment of FIGS. 4*a* and 4*b*, and 5*a* and 5*b*, the length of the tube 30 required for the same function simply is within the confines of the beverage container, with a sliding seal 70 allowing the beverage inlet tube 30 to slide through the seal as necessary on the withdrawal of the dispenser assembly. In that regard, such a seal may take many forms, as the beverage inlet tube 30 typically will be both flexible and somewhat stretchable so that the beverage inlet tube, when pulled, will sort of extrude itself through a relatively rigid seal without leakage. In some embodiments, it may be advantageous to place some form of stop, like an enlarged diameter, on the flexible tube 30 to prevent a user from accidentally pulling the entire tube through the seal, allowing the beverage to be expelled under pressure through the now open seal. In that regard, one might choose to provide some extra length of the beverage inlet tube 30 so that the dispenser assembly may be used like a hand-held dispenser on a tube or hose, which could be more convenient, such as when the beverage container itself is not conveniently located in a refrigerator, bucket of ice, etc.

Figure 6A:
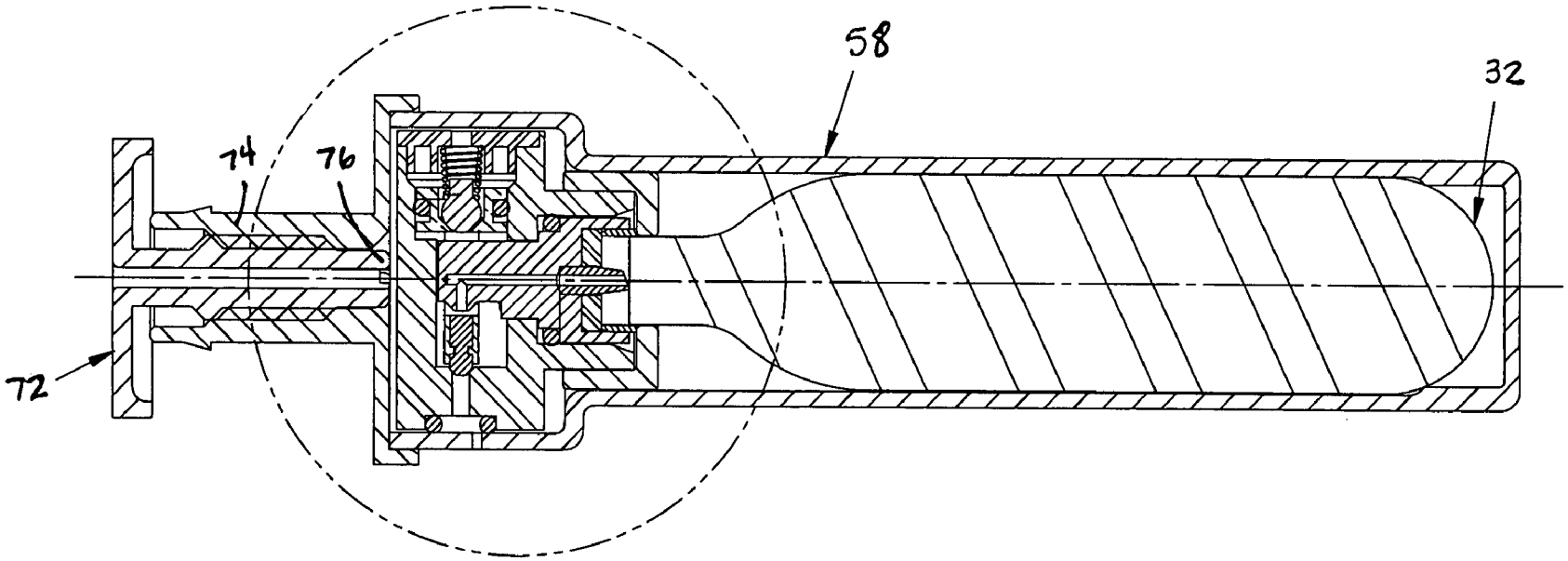
FIGS. 6*a*, 6*b* and 6*c* are a cross-section taken through the gas cartridge and pressure regulator assembly of the embodiments of FIGS. 4*a* and 4*b*, and 5*a* and 5*b*, a cross-section of the regulator of FIG. 6*a* taken on an expanded scale, and an exploded view, primarily of the regulator taken at an angle to illustrate the shape of certain key parts in the third dimension, respectively.
Figure 6B:
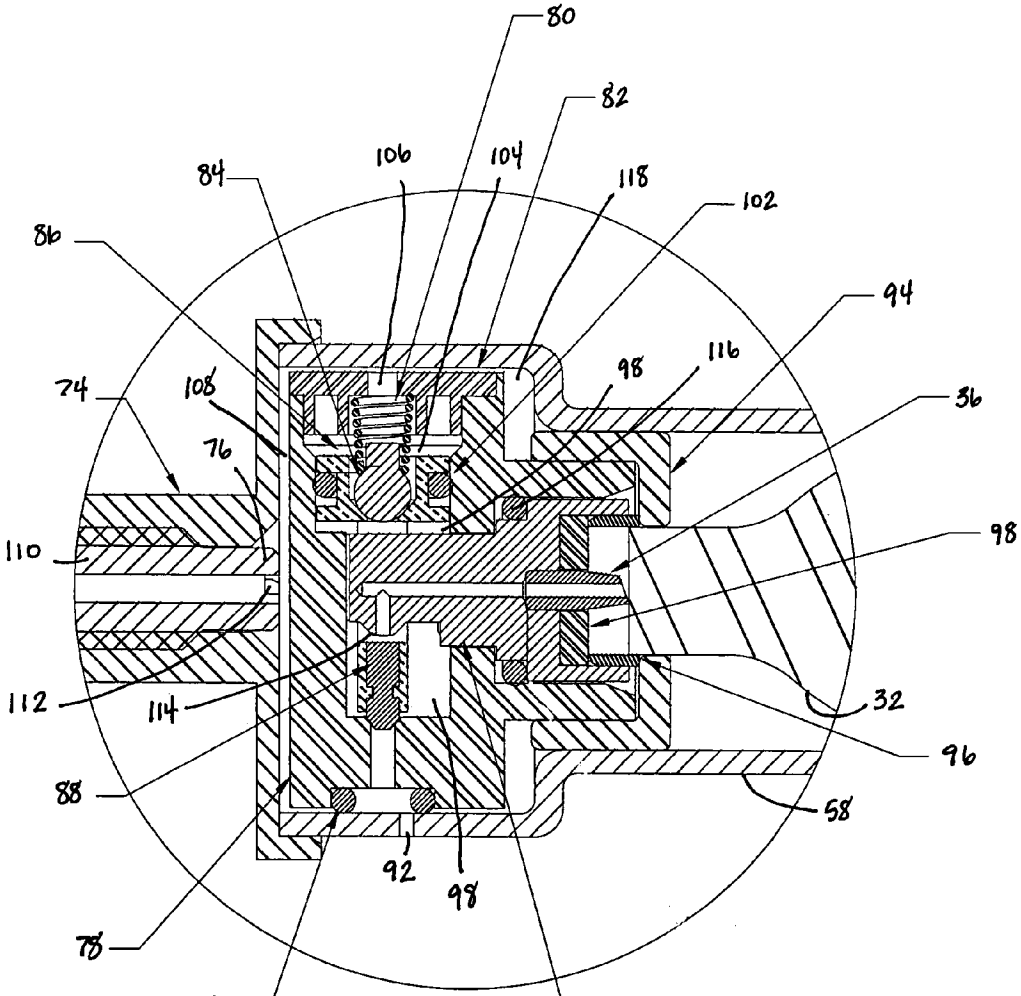
Figure 6C:
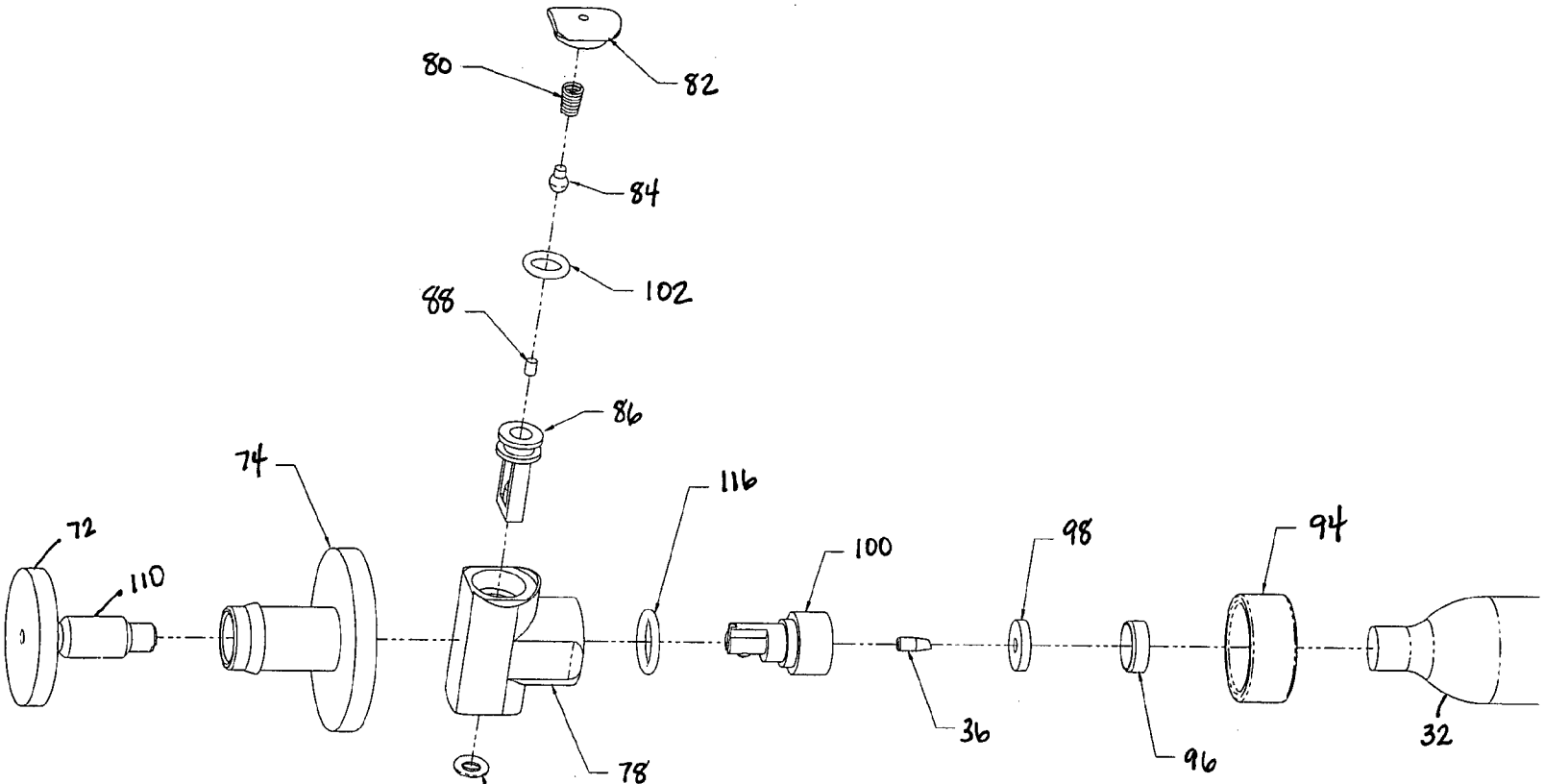

As previously mentioned, the regulator 34 may be in accordance with any well-known pressure regulator design. By way of specific example, FIGS. 6*a*, 6*b* and 6*c* provide details on one such regulator that may be used in the present invention. FIG. 6*a* is a cross-section taken through the gas cartridge and pressure regulator assembly of the embodiments of FIGS. 4*a* and 4*b*, and 5*a* and 5*b*. FIG. 6*b* is a cross-section of the regulator of FIG. 6*a* taken on an expanded scale, and FIG. 6*c* is an exploded view, primarily of the regulator taken at an angle to illustrate the shape of certain key parts in the third dimension. Prior to use, piercing knob 72, threaded into the regulator tube cap 74, will be at a position such that the end 76 of the regulator tube cap will not be putting pressure on the regulator housing 78, and typically will be slightly separated therefrom. In this position, coil spring 80, acting between spring seat 82 fixed to the regulator housing 78, pushes against relief ball 84, which in turn pushes against piston 86 to push the piston assembly down (relative to the orientation of the illustrations), forcing backflow check and regulator valve member 88 against the lower seat on the regulator housing 78. An O-ring 90 provides a seal between the regulator housing 78 and the housing 58 so that the backflow check and regulator valve member 88 will prevent any backflow of beverage or gas through hole 92 in housing 58 into the regulator mechanism. In addition, housing 58 may be provided with a separate check valve such as duckbill 120, as shown in FIGS. 4*a*, 4*b*, 5*a* and 5*b*, to prevent backflow.

In this position, the gas cartridge 32 will be spaced from, or merely lying against, the end of piercer 36, the end of the cartridge 32 extending into the regulator housing retainer 94 and the end of the cartridge face seal retainer 96. The cartridge face seal 98 will be an elastic member, such as rubber or elastic or resilient plastic, to seal against the end of the gas cartridge 32 when the piercer 36 is forced into the end of the gas cartridge to pierce the same. In that regard, preferably the cartridge face seal retainer 96 will provide some degree of temporary sealing during the motion of the piercer 36 into the end of the gas cartridge 32.

When the dispenser assembly is ready to be used, the piercing knob 72 is screwed in, with the end 76 thereof pushing against the regulator housing 78 to slide the entire regulator assembly to the right against the end of gas cartridge 32, forcing piercer 36 to pierce the end of the cartridge, with the regulator assembly stopping when the end of the gas cartridge 32 is tightly abutting the cartridge face seal 98. Once the gas cartridge is pierced, gas pressure will rapidly increase in region 98 around the seal insert 100, acting against piston 86 to start to move the piston assembly 86 upward, with the piston O-ring 102 sealing between the piston 86 and the regulator housing 78. When the piston assembly begins to move upward, the backflow check and regulator valve member 88 lifts off the seat in regulator housing 78, now coupling pressurized region 98 to the interior of the beverage container through hole 92 in housing 58. In that regard, O-ring 90 has a sufficient diameter to provide a limited sliding seal as required for the motion of the assembly during the piercing of the gas cartridge. The upward motion of the piston assembly is resisted by spring 80, the region 104 above the piston assembly being vented through opening 106, space 108 and the hollow stem 110 coupled to the piercing knob 72. In that regard, the end 76 on stem 110 is not flat, but has at least one notch or relief 112 to provide a gas flow passage. Thus when the pressure in region 98 rises enough to overcomes the force on the spring 80, the piston 86 will move sufficiently upward for the backflow check and regulator valve member 88 to be forced against the seat 114 on the regulator housing 78 to stop the further flow of gas from the cartridge 32 out through valve seat 114, region 98 and opening 92 into the beverage container, until such time as the pressure in the beverage container is reduced, typically by the dispensing of beverage. Thus the pressure regulator will maintain a relatively uniform pressure in the beverage container during its use until the beverage container is emptied.

While region 98 is subject to gas pressure, normally equal to the pressure in the beverage container, O-ring 116 prevents leakage around the outer diameter of the seal insert 100. Sealing is not required, however, between the seal insert 100 and the regulator housing retainer 94 or between the regulator housing retainer 94 and the housing 58, because of the fact that region 118, as well as housing 58, is isolated from the pressurized regions and vented to the atmosphere. Also normally the relief ball 84 is always forced against the seat in the piston 86 by the spring 80, though in the event of some failure of the pressure regulator to operate properly, the pressure in region 98 will increase abnormally as the contents of gas cartridge 32 are dispensed, forcing relief ball 84 off the seat to vent region 98 to regions 118, 108 and out through the hollow stem 110 of the piercing knob 72 to vent the excess pressure before any possibility of over-pressurizing the beverage container.

Thus there have been disclosed herein disposable beverage dispensers that initially are contained entirely or at least substantially entirely within a beverage container, but which may be removed therefrom and placed in an operative position, pressurizing the contents of the container, avoiding prolonged contact between the contents of the container and air, providing a dispensing force for control by a simple dispensing valve and in those instances where it is desired, maintaining carbonation on the beverage. In certain instances, various features of the present invention have been illustrated schematically, as specific design details are merely a matter of design choice. If not initially contained entirely within the beverage container (level or below the surface of the container top or wall), the disposable dispensers of the present invention will preferably be at least 90% and more preferably at least 95% within the beverage container, and preferably configured and positioned relative to the container so as to not interfere with the stacking of multiple beverage containers for storage, and in some implementations, also disposed relative to the container top to either be used to plug a central fill hole in the container top after filing, or to not interfere with center filling equipment using a standard plug to plug the center fill hole after filling, as in a conventional center fill beverage container.

Thus, while the present invention has been disclosed and described with respect to preferred embodiments thereof, it will be understood that are skilled in the art that various changes in form and detail may be made therein without departing from the spirit and scope of the invention.

What is claimed is:

1. A disposable beverage dispenser comprising:

at least one enclosure adapted to couple to and extend into the top of a beverage container having a top and a bottom and containing a gas cartridge, a gas cartridge piercer and a pressure regulator disposed adjacent the gas cartridge and configured to controllably pierce the gas cartridge to provide gas under pressure to the pressure regulator, the pressure regulator having a pressure regulator output configured to couple to the interior of a beverage container, and a beverage dispenser head, the beverage dispenser head being coupled to a flexible tube extending through the at least one enclosure, the disposable beverage dispenser being configured and positioned relative to the container top so as to not interfere with the stacking of multiple beverage containers for storage, the dispenser head being disposed in the at least one enclosure entirely below a top surface of the beverage container, and being removable from the at least one enclosure for operation as a beverage dispenser with the beverage container resting on its bottom, the flexible tube having a sufficient length to allow removal of the beverage dispenser head from the at least one enclosure while still extending through the at least one enclosure.

2. The dispenser of claim 1 wherein the at least one enclosure comprises a single enclosure.

3. The dispenser of claim 2 wherein the beverage dispenser head is rotatably connected to an assembly of the gas cartridge, the piercer and the pressure regulator, the beverage dispenser head being configured to rotate through 90 degrees to cooperatively engage a top of a beverage container on which it may be mounted.

4. The dispenser of claim 3 wherein the rotation of the beverage dispenser head relative to the assembly of the gas cartridge and the pressure regulator provides a cam action to cause the piercer to pierce the gas cartridge to provide gas under pressure to the pressure regulator.

5. The dispenser of claim 1 wherein a sufficient length of flexible tubing is stored within the single enclosure to allow removal of the beverage dispenser head from the at least one enclosure.

6. The dispenser of claim 1 further comprised of a check valve disposed to prevent a beverage or gas from flowing back into the pressure regulator.

7. The dispenser of claim 1 wherein the at least one enclosure comprises first and second enclosures, the first enclosure containing the gas cartridge, the gas cartridge piercer and the pressure regulator, and the second enclosure containing the beverage dispenser head.

8. The dispenser of claim 7 wherein one of the enclosures is sealably coupled to a center of the container top.

9. The dispenser of claim 7 wherein the flexible tube extends through the enclosure containing the beverage dispenser head, the flexible tube sliding through a seal between the inside and outside of the respective enclosure to allow the flexible tube to slide through the seal on removal of the beverage dispenser head from the respective enclosure, the flexible tube having a sufficient length to allow removal of the beverage dispenser head from the respective enclosure while still extending through the respective enclosure.

10. The dispenser of claim 7 further comprising a piercing knob disposed for manual rotation to force the pressure regulator and piercer against the gas cartridge to pierce the cartridge and provide gas under pressure to the pressure regulator.

11. A disposable beverage dispenser comprising:

an enclosure adapted to couple to and extend into the top of a beverage container having a top and a bottom, and containing a gas cartridge, a gas cartridge piercer and a pressure regulator disposed adjacent the gas cartridge and configured to controllably pierce the gas cartridge to provide gas under pressure to the pressure regulator, the pressure regulator having a pressure regulator output configured to couple to the interior of a beverage container, and a beverage dispenser head, the beverage dispenser head being coupled to a flexible tube extending through the enclosure, the disposable beverage dispenser being disposed below a top surface of the beverage container so as to not interfere with the stacking of multiple beverage containers for storage, the dispenser head being removable from the enclosure for operation as a beverage dispenser with the beverage container resting on its bottom, the flexible tube having a sufficient length to allow removal of the beverage dispenser head from the enclosure while still extending through the enclosure.

12. The dispenser of claim 11 wherein the disposable beverage dispenser is sealably coupled to a center of the container top.

13. The dispenser of claim 11 wherein the beverage dispenser head is rotatably connected to an assembly of the piercer, the gas cartridge and the pressure regulator, the beverage dispenser head being configured to rotate through 90 degrees to cooperatively engage a top of a beverage container on which it may be mounted.

14. The dispenser of claim 13 wherein the rotation of the beverage dispenser head relative to the assembly of the gas cartridge and the pressure regulator provides a cam action to cause the piercer to pierce the gas cartridge to provide gas under pressure to the pressure regulator.

15. The dispenser of claim 11 wherein a sufficient length of flexible tubing is stored within the enclosure to allow removal of the beverage dispenser head from the enclosure.

16. The dispenser of claim 11 further comprised of a check valve disposed to prevent beverage from flowing into the pressure regulator.

17. A disposable beverage dispenser comprising:

a first enclosure adapted to couple to and extend into a beverage container through its top and containing a gas cartridge, a gas cartridge piercer and a pressure regulator disposed adjacent the gas cartridge and configured to controllably pierce the gas cartridge to provide gas under pressure to the pressure regulator, the pressure regulator having a pressure regulator output configured to couple to the interior of a beverage container; and, a second enclosure adapted to couple to and extend into a beverage container through its top and containing a beverage dispenser head, the beverage dispenser head being coupled to a flexible tube extending through the second enclosure, the disposable beverage dispenser being configured and positioned below a to surface of the beverage container so as to not interfere with the stacking of multiple beverage containers for storage, the dispenser head being removable from the second enclosure for operation as a beverage dispenser with the beverage dispenser resting on its bottom, the flexible tube having a sufficient length to allow removal of the beverage dispenser head from the second enclosure while still extending through the second enclosure.

18. The dispenser of claim 17 wherein the flexible tube extends through the enclosure containing the beverage dispenser head, the flexible tube sliding through a seal between the inside and outside of the respective enclosure to allow the flexible tube to slide through the seal on removal of the beverage dispenser head from the respective enclosure, the flexible tube having a sufficient length to allow removal of the beverage dispenser head from the respective enclosure while still extending through the respective enclosure.

19. The dispenser of claim 17 further comprised of a check valve disposed to prevent beverage from flowing into the pressure regulator.

20. The dispenser of claim 17 further comprising a piercing knob extending out of the first enclosure and disposed for manual rotation to force the pressure regulator and piercer against the gas cartridge to pierce the cartridge and provide gas under pressure to the pressure regulator.

21. The disposable beverage dispenser of claim 1 wherein the gas cartridge, the gas cartridge piercer, the pressure regulator and the beverage dispenser head are all disposed entirely below an upper surface of the container, the beverage dispenser head being removable from the at least one enclosure for operation as a beverage dispenser.

* * * * *